US007300368B2

(12) United States Patent
Hylak

(10) Patent No.: US 7,300,368 B2
(45) Date of Patent: Nov. 27, 2007

(54) HOCKEY GAME TABLE PUCK WITH WEIGHTED PERIMETER

(75) Inventor: Peter J. Hylak, McKinney, TX (US)

(73) Assignee: Sop Services, Inc., Las Vegas, NV (US)

( * ) Notice: Subject to any disclaimer, the term of this patent is extended or adjusted under 35 U.S.C. 154(b) by 209 days.

(21) Appl. No.: 11/003,160

(22) Filed: Dec. 3, 2004

(65) Prior Publication Data

US 2005/0130775 A1 Jun. 16, 2005

Related U.S. Application Data

(60) Provisional application No. 60/530,028, filed on Dec. 16, 2003.

(51) Int. Cl.
*A63F 7/06* (2006.01)
*A63B 67/14* (2006.01)

(52) U.S. Cl. ..... 473/588

(58) Field of Classification Search ..... 473/588, 473/589

See application file for complete search history.

(56) References Cited

U.S. PATENT DOCUMENTS

| | | | | |
|---|---|---|---|---|
| 2,494,929 | A | 1/1950 | Colaluca | |
| 2,798,722 | A * | 7/1957 | Fluhrer | 473/588 |
| 4,503,635 | A | 3/1985 | Harrington | |
| 4,889,347 | A * | 12/1989 | Mineart | 473/588 |
| 4,940,441 | A | 7/1990 | Novinsky | |
| D367,902 | S | 3/1996 | Silk | |
| 5,501,468 | A | 3/1996 | Browne | |
| 5,518,237 | A * | 5/1996 | Bellehumeur | 473/588 |
| 5,671,925 | A | 9/1997 | Gonzalez | |
| 5,676,376 | A * | 10/1997 | Valley | 273/288 |
| 6,021,949 | A | 2/2000 | Boiron | |
| 6,089,998 | A * | 7/2000 | O'Neal et al. | 473/588 |
| 6,174,214 | B1 * | 1/2001 | Cooper | 446/46 |
| 6,488,210 | B2 | 12/2002 | Schumi et al. | |
| 2002/0119845 | A1 | 8/2002 | O'Farrell | |
| 2005/0064967 | A1 * | 3/2005 | Coleman et al. | 473/588 |
| 2005/0130775 | A1 * | 6/2005 | Hylak | 473/588 |

* cited by examiner

*Primary Examiner*—Raleigh W. Chiu
(74) *Attorney, Agent, or Firm*—Woodard, Emhardt, Moriarty, McNett & Henry LLP

(57) ABSTRACT

In preferred embodiments, the game pieces of the present invention concentrate the mass and weight of the game piece away from the center of the game piece and around the periphery. Preferably the center portion of the game piece has a minimum of weight while maintaining the ability of the game piece to function correctly. In another preferred embodiment of the present invention, a game piece for a simulated hockey game encompasses a peripheral portion which is configured to slide on a simulated hockey game surface and having at least one central portion mounted within the peripheral portion. Optionally, the at least one central portion is made of a material different than the material of the peripheral portion.

15 Claims, 4 Drawing Sheets

HOCKEY GAME TABLE PUCK WITH WEIGHTED PERIMETER

The present application claims the benefit of provisional application Ser. No. 60/530,028, filed Dec. 16, 2003, incorporated herein by reference.

BACKGROUND OF THE INVENTION

The present invention deals with hockey pucks or game pieces for games such as simulated hockey games, typically hockey game tables or games supported on flat surfaces such as tables. Puck pieces are typically used with hockey game tables with solid surfaces or with AIR-HOCKEY® forced air style tables. The game pieces are normally propelled by the game players using handles or mallets. In vigorous games, the game pieces can sometimes leave the surface of the game table and become airborne. The game piece may land within the playing area or may sometimes leave the table, causing a disruption to the game. It is preferred to have a game playing piece which enhances play and minimizes game disruptions.

The present invention addresses these and other needs.

SUMMARY OF THE INVENTION

In certain preferred embodiments, the game pieces of the present invention concentrate the mass and weight of the game piece away from the center of the game piece and around the periphery. Preferably the center portion of the game piece has a minimum of weight while maintaining the ability of the game piece to function correctly.

In a preferred embodiment of the present invention, a game piece for a simulated hockey game includes a peripheral portion configured to slide on a simulated hockey game surface and a central portion within the peripheral portion. The majority of the mass of the game piece is in the peripheral portion.

In another preferred embodiment of the present invention, a game piece for a simulated hockey game encompasses a peripheral portion which is configured to slide on a simulated hockey game surface and has at least one central portion mounted within the peripheral portion. Optionally, the at least one central portion is made of a material different than the material of the peripheral portion.

In yet another preferred embodiment of the present invention, a game piece for a simulated hockey game has a peripheral portion configured to slide on a simulated hockey game surface. The peripheral portion defines an opening through the height of the peripheral portion, and a central portion is mounted to the peripheral portion to substantially close the opening.

It is an object of certain embodiments of the present invention to provide a game piece.

Other objects and advantages of embodiments of the present invention will be apparent from the description, figures and claims.

DESCRIPTION OF PREFERRED EMBODIMENTS

Figure 1:
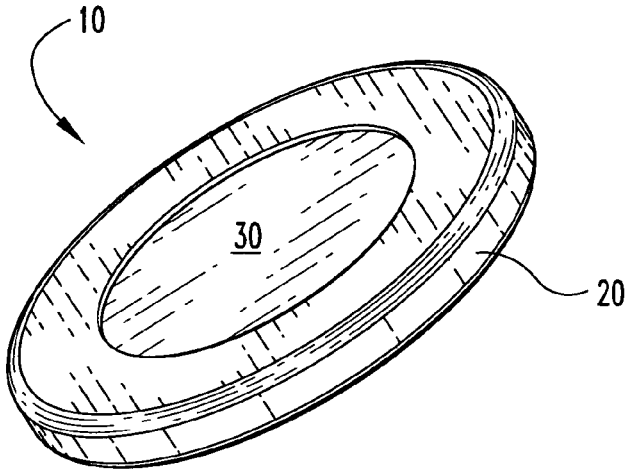
FIG. 1 illustrates a perspective view of a preferred embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein are contemplated as would normally occur to one skilled in the art to which the invention relates.

In certain preferred embodiments, the present invention provides game pieces for games. Preferably the present invention is used with simulated hockey games which are typically game tables or games supported on tables. The game pieces are generally substantially flat or planar and designed to slide or float over the game surface. According to one preferred advantage, the present invention minimizes the chances of the game piece (i.e., a puck) becoming airborne or leaving the playing area during play.

A conventional hockey game table has a playing surface defining a playing area, usually surrounding by a rail or railing. The playing surface is typically substantially flat. In some games, the surface is solid and polished to minimize friction between the game piece and the playing surface. In alternate games, the surface allows forced air upward through spacing openings, which creates an air cushion upon which the game piece travels or glides. The game pieces of the present invention are usable with various types of games and/or game tables, which are considered conventional for purposes of the present invention and are not described herein in detail.

In preferred embodiments, the game pieces of the present invention concentrate the mass and weight of the game piece away from the center of the game piece and around the periphery. Preferably the center portion of the game piece has a minimum of weight while maintaining the ability of the game piece to function correctly.

Traditional hockey game pieces have a circular profile; however, various geometric shaped profiles may be used, for example triangles, squares (FIG. 8), rectangles, pentagons and hexagons. In one option, the corners of certain profiles are chamfered or rounded to enhance game play and to minimize stresses on sharp corners. Separately, optionally the peripheral edge or edges wrapping from the top or bottom to the outside face of the game piece include a slight radius to minimize material stresses, such as burrs or scratches, and to enhance game play. A typical circular profile is illustrated for clarity. The present invention is not limited to one geometric profile.

Top, bottom, face and vertical references herein are from the perspective of a substantially planar game piece parallel to a game playing surface. Generally the bottom of the game piece is closest to the game playing surface, with the game piece having a height rising to a top surface parallel to and opposite the bottom surface. Top and bottom references herein are considered relative and may change if the game piece is flipped over.

In one feature, the present invention provides a perimeter weighted portion configured to slide on a simulated hockey game surface and arranged to concentrate the majority of the weight and/or mass of the game piece along the perimeter of the piece. A minimum of weight is in the central portion of the game piece. This enhances game play and assists the game piece in remaining generally upon the playing surface during use. For example, spreading the weight and mass makes the game piece more stable and consequently makes it more difficult for the piece to flip or become airborne.

Figure 2:
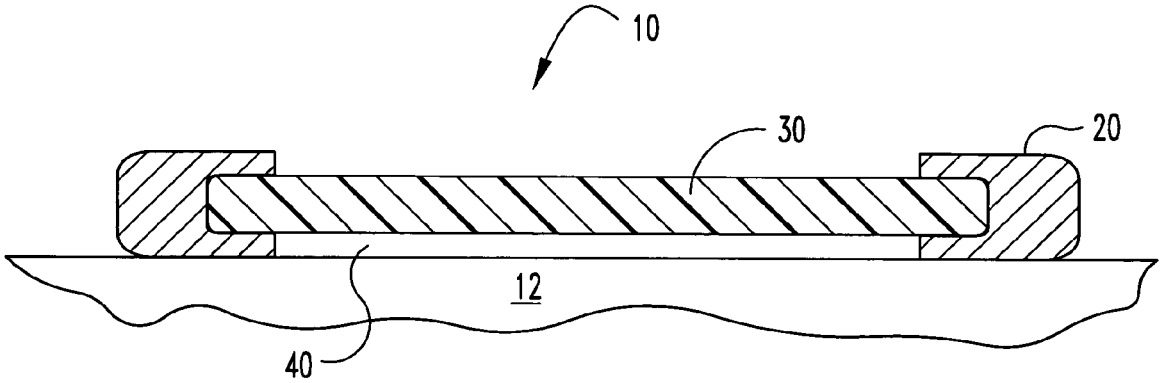
FIG. 2 illustrates a cross-sectional view of the embodiment of FIG. 1.
Figure 3:
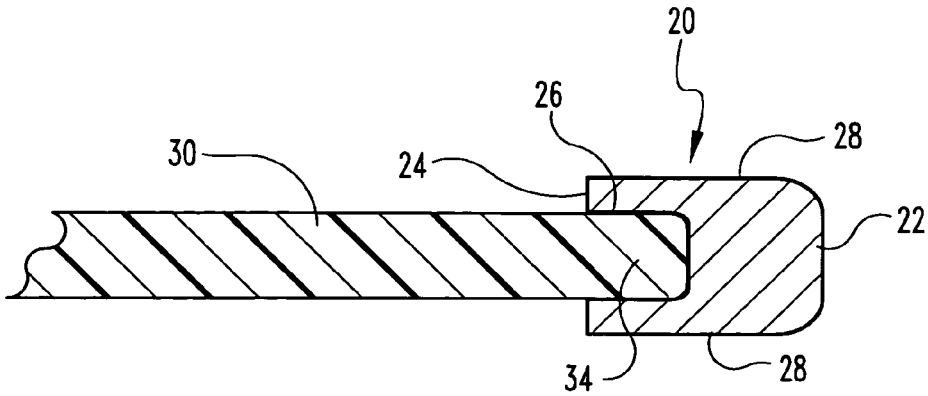
FIG. 3 illustrates an partial, enlarged cross-sectional view of the preferred embodiment of FIG. 1.
Figure 4:
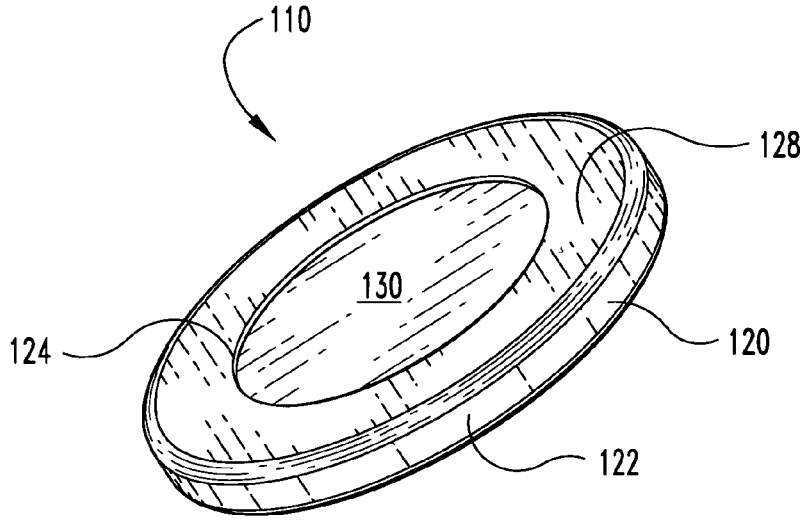
FIG. 4 illustrates a perspective view of an alternate preferred embodiment of the present invention.
Figure 5:
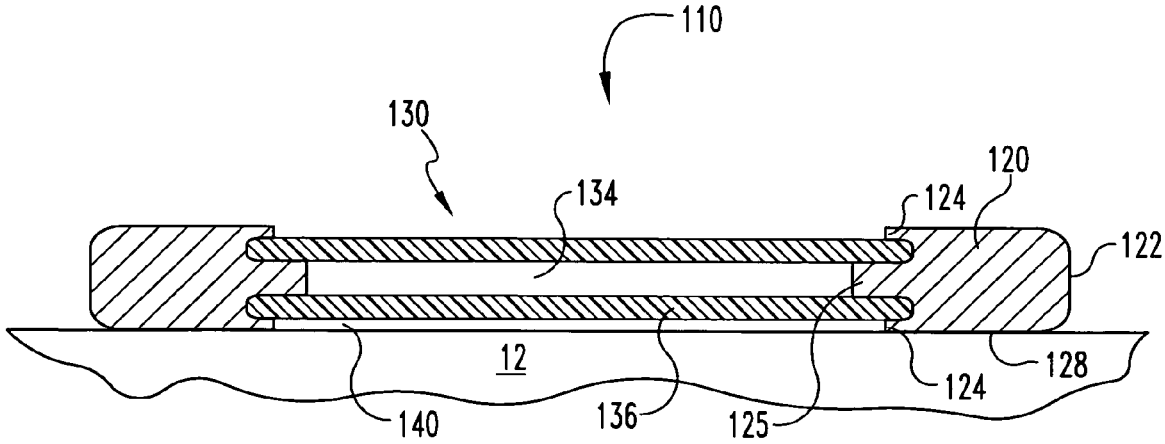
FIG. 5 illustrates a cross-sectional view of the preferred embodiment of FIG. 4.
Figure 6:
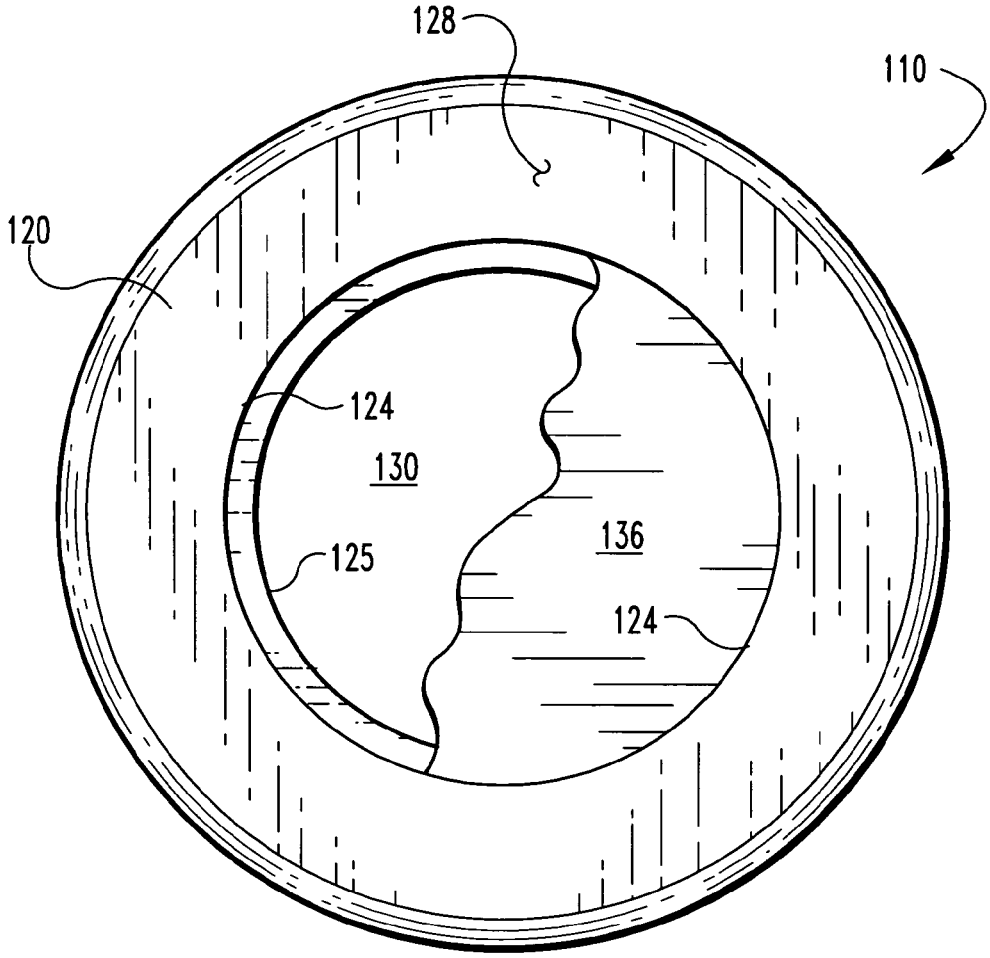
FIG. 6 illustrates a partially cut-away top view of the preferred embodiment of FIG. 4.
Figure 7:
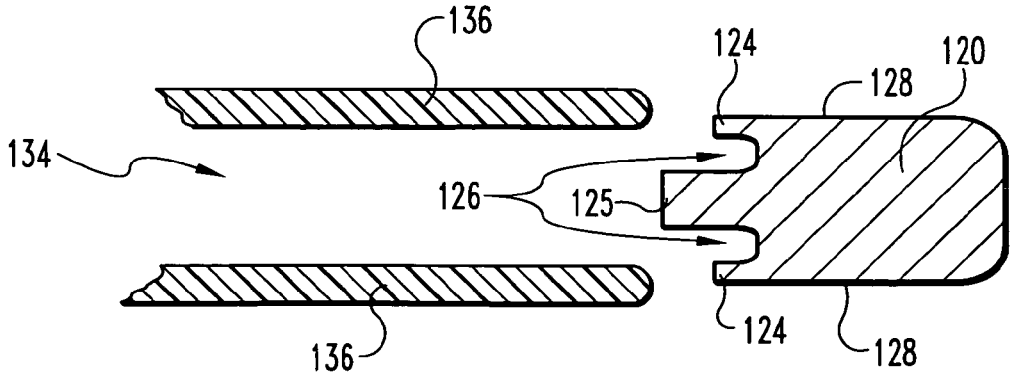
FIG. 7 illustrates a top view of the preferred embodiment of FIG. 4.

In one embodiment, shown in FIGS. 1-3, a game piece 10 includes a central portion 30 defined in a perimeter portion 20. Central portion 30 has an outer edge or periphery portion 34 optionally received and snugly held within a defined slot 26 in the perimeter portion 20. Perimeter portion 20 includes an outer diameter with outer face 22, portions 24 defining an inner diameter, and top and bottom faces 28. The inner diameter of perimeter portion 20 defines a central opening through the height of the perimeter portion which is closed by central portion 30 to define upper and lower air wells 40. The downward facing air well may capture air and assists in floating the game piece over a playing surface 12. The air wells are preferable substantially sealed between the perimeter portion and the central portion.

Various structures and arrangements may be used to mount the central portion to a perimeter portion without detracting from the present invention. In one embodiment of manufacturing the game piece, a periphery portion is placed in a mold and the central portion is poured into the mold in a liquid form until a desired height is reached. The central portion liquid is then cured to form a desired solid material across the central diameter and extending into slot 26. Alternately, if central portion 30 is sufficiently flexible as a disc or film, the outer edge 34 may be flexed and introduced into slot 26. Alternately, the perimeter portion 20 may be formed, extruded or machined around the central portion 30. Preferably perimeter portion 20 is formed in one piece, but alternately may be made in one or more pieces to be assembled around the central portion, for example with a snap together fit.

As a non-limiting example, the game piece 10 may have an outer diameter of 2.56 inches (65 mm) and a perimeter portion 20 with an inner diameter of approximately 2.15 inches (54.4 mm). Slot 26 may have a diameter of approximately 2.3 inches (58.5 mm) and central portion 30 may have a substantially matching diameter of approximately 2.22 inches (56.5 mm). The perimeter portion can have an example height of approximately 0.186 inches (4.8 mm) or 3/16" between the top and bottom faces. In one example embodiment, perimeter portion 20 is formed of 12 grams of aluminum, and central portion 30 is formed of 3.2 grams of high impact polystyrene.

Illustrated in FIGS. 4-7 is a game piece 110 according to an alternate preferred embodiment of the present invention. The game piece 110, shown as a circular hockey puck, is typically used with and supported on or slightly above a playing surface 12 of a simulated hockey game. As illustrated, game piece 110 includes a perimeter portion 120 and a central or interior area 130. Perimeter portion 120, shown in a ring style, typically includes an outside, typically smooth perimeter face 122, and has symmetric, preferably polished or smooth, top and bottom faces 128. Generally the top and bottom faces of the entire game piece 110 are smooth and symmetric.

In certain embodiments, one or more central portions or pieces are mounted within the center of a perimeter portion. The central portion generally extends across and closes a central vertical opening defined through the perimeter portion. In one mounting arrangement, the perimeter portion 120 has an inner periphery with an inner diameter and preferably defines one or more slots to receive the outer periphery of central portion pieces 136. As illustrated in detail in FIGS. 5-7, the inner diameter may include a central shelf 125 between two outer flanges 124, defining and spacing apart two rings or slots 126 adjacently above and below shelf 125 respectively.

Lightweight central pieces 136, such as plastic discs, are received in slots 126 and separated by shelf 125. Preferably central pieces 136 have an outer diameter slightly greater than the inner diameters of flanges 124 and shelf 125, while less than the outer diameter of perimeter 120. Preferably the central piece diameter fits into slots 126.

In the embodiment illustrated, an air chamber 134 separates the central pieces 136. Air chamber 134 may be empty or optionally filled with a desired material for weighting, sound dampening, support or to effect playing characteristics.

In an alternate embodiment, game piece 110 is formed with a central shelf 125, but without flanges 124 or slots 126. In this embodiment, central pieces 136 abut and may be attached to shelf 125, for example using adhesive.

In one option, perimeter portion 120 has sufficient height to secure central pieces 136 at a relatively higher height spaced from support or playing surface 12 than top or bottom face 128. This height defines a cavity or air pocket (also called a well) 140 between the playing surface 12 and the central portion 130, within the interior periphery of perimeter portion 120. In forced air games, the air pocket 140 receives and partially retains the forced air, providing lift to the game piece. The well height may be varied in alternate embodiments to provide differing playing characteristics, and can optionally be greater on one of the top and bottom sides than on the other.

For purposes of illustration, and as a non-limiting example, certain dimensions are described. Preferably the game piece has an industry standard size and weight, but variations in size and weight will be understood by those of skill in the art. For example, in one embodiment of a hockey puck for a forced air table, the game piece has a weight of approximately 0.5 ounces. The typical hockey game piece for a home game table has an outer diameter or major axis of approximately 2.5 inches. In an alternate embodiment, an industry standard size uses a commercial game table piece with a diameter of approximately 3.5 inches, with the sizes of the components scaled appropriately.

In certain features, the perimeter portion has a greater mass and/or density than the central portion to appreciably concentrate at least the majority of the weight and mass of the game piece along the outer perimeter portion. As one example, the central piece or pieces have a total weight of approximately 0.05 oz and the perimeter portion has a weight of approximately 0.5 oz, for a total game piece weight of approximately 0.55 oz. The weight of the game piece for a home game can be varied, for example within a range of +/−0.2 oz., while maintaining its primary performance characteristics. In this example, approximately 90% of the game piece total mass is in the perimeter portion, with the central portion being approximately 10% of the total mass.

With respect to game piece 110, the perimeter portion can have an example height of approximately 0.186 inches or 3/16" with top and bottom faces 28 having a difference between the outer diameter and inner diameter of approximately 3/16". Preferably, central portion 130 is spaced to form an approximately 0.020-0.030" deep well from the top or bottom face.

In the embodiment shown, perimeter portion 120 has an example height of 0.186 inches, an outer diameter of approximately 2.562 inches, an inner diameter along shelf 125 of 2.021 inches, an inner diameter along flanges 124 of 2.145 inches and slots 126 with a diameter of approximately 2.205 inches. Slots 126 have a depth of 0.062 inches from the edge of shelf 125. Flanges 124 may be undercut from shelf 125 by approximately 0.030 inches to facilitate fitting central pieces 136 into slots 126.

The central pieces 136 have a height between 0.012 and 0.030 inches and a diameter of approximately 2.205 inches to be snap-fit into slots 126, defining top and bottom air wells with a height of 0.032 inches respectively. In the embodiment shown, central air chamber 134 has a height of 0.062 inches. Further in this embodiment, central portions 136 have a diameter approximately 80% of the outer diameter of the perimeter portion 120.

In certain preferred embodiments, the perimeter portion is made from a material different from the material of the central portion. In a less preferred embodiment, a game piece is formed of one material and/or the perimeter portion and central portion are integrally formed. In an alternate less preferred embodiment, not usable on a forced air table, a game piece is formed with a ring-type outer perimeter and an open central portion without material. As one non-limiting example, the perimeter portion may be made from a reactive, vibrant metal material to enhance game play, for example #6061T6 hardened aluminum, while the central piece or pieces are made from a plastic material such as Mylar® film or a HIPS plastic.

Preferably, a metal perimeter portion is made from a durable resilient metal with polished faces, able to resist wear or burrs traditionally caused by heavy use, and which allows the game piece to rebound and ricochet well in use. For example, in forced air games, a smooth surface assists in maintaining the air seal needed for the game piece to float or glide across the playing surface. Using a durable material harder than traditional plastic minimizes irregularities, such as burrs, formed in the game piece surface from use, which can interfere with the game piece aerodynamics.

Alternately the perimeter portion can be made from a plastic material of different weight, density or mass than the central portion. Preferably the perimeter portion is formed in one piece to balance the weight evenly and to avoid irregularities, but optionally the perimeter is weighted unevenly to add an element of unpredictability to the game.

For purposes of illustration, and as a non-limiting example, central pieces 136 have a total weight of approximately 0.05 oz and perimeter portion 120 has a weight of approximately 0.5 oz, for a total game piece weight of approximately 0.55 oz. The weight of the game piece can be varied, for example within a range of +/−0.2 oz., while maintaining its primary performance characteristics. In this example, approximately 90% of the game piece total mass is in the perimeter portion, with the central portion being approximately 10% of the total mass.

The central pieces may be made from a plastic type of material in various configurations. Optionally, the material may be solid, transparent or translucent. The material may also be decorated or imprinted with various colors, logos, text, decals and/or advertisements. In one option, the central portion and perimeter portion colors may be coordinated as matching or contrasting for visual appeal or to endorse a particular team's color combination. In an alternate option, a logo, decal or printed material may be placed or printed on the inside of the central pieces or placed in air chamber 134 to be protected by a transparent central portion yet visible from the exterior of the game piece.

Alternately, the central portion is secured relative to the perimeter portion using other methods or structures. In an alternate preferred embodiment, a central portion has a frictional fit with the inner circumference of the perimeter portion, and optionally can be secured by adhesive. In a different alternative, central portion can be placed over an inner shelf formed in the perimeter portion and secured in place by adhesive, a washer, or a ring or seal fitting over the central portion and engaging the perimeter. Still further, the central portion can be formed in layers where the outer layers engage the perimeter portion.

In other examples, the perimeter portion can be molded, machined, diecast or stamped. In a still further assembly method, the perimeter portion is made in separate top and bottom pieces, which engage each other and secure or sandwich the central portion between them.

Figure 8:
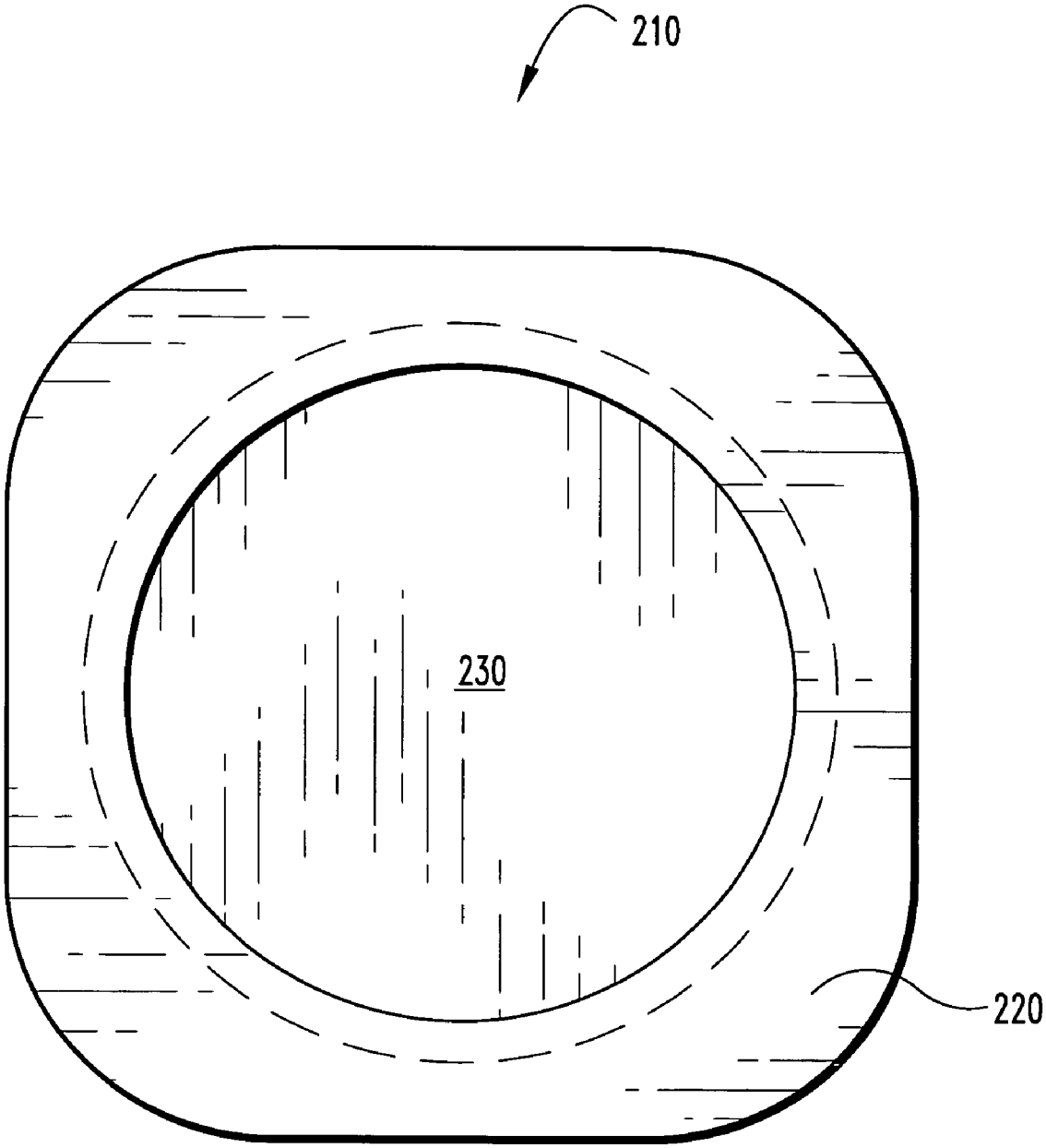
FIG. 8 illustrates a perspective view of a different preferred embodiment of the present invention.

FIG. 8 illustrates a different embodiment of a game piece 210, with a substantially square profile with rounded corners, having a weighted perimeter portion 220 and a central portion 230. The corners may be rounded, for example with a 3/4" radius to assist in play. A feature illustrated in this preferred embodiment is that the mass and weight are symmetrically balanced with respect to the corners of the perimeter portion 220. Central portion 230 may be secured to perimeter portion 220 using a variety of structures, such as those described above. Circular portion 230 may have a circular profile or a profile matching the outer profile of the game piece. The central portion and inner periphery profiles typically match so that the central portion closes the central opening defined in the perimeter portion.

In different preferred embodiments, the central portion and/or perimeter portion of the game piece can be selected or changed in mass or profile at the user's choice to define different game piece weight levels, weight distributions, game piece heights and air well depths to provide differing game piece characteristics during game play.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A game piece for a simulated hockey game, comprising a peripheral portion configured to slide on a simulated hockey game surface and a central portion within said peripheral portion, wherein the majority of the mass of said game piece is in said peripheral portion, wherein said central portion has an outer periphery and said peripheral portion has an inner periphery defining at least one slot, said outer periphery of said central portion being received in said slot to mount said central portion to said peripheral portion, wherein said peripheral portion has an outer periphery and top and bottom flat surfaces extending from said inner periphery of said peripheral portion to said outer periphery of said peripheral portion, said central portion being inset between said top and bottom flat surfaces, and wherein said central portion is made of plastic and said peripheral portion is made of metal.

2. The game piece of claim 1, wherein approximately ninety percent of the mass of said game piece is in said peripheral portion.

3. The game piece of claim 1, wherein said inner periphery of said peripheral portion has a diameter at least approximately eighty percent of a diameter of said outer periphery of said peripheral portion.

4. The game piece of claim 1, wherein said slot has a circular periphery.

5. The game piece of claim 4, wherein said outer periphery of said peripheral portion is substantially circular.

6. The game piece of claim 4, wherein said outer periphery of said peripheral portion is substantially square.

7. The game piece of claim 1, wherein said peripheral portion defines at least two slots in said inner periphery, wherein at least two central portions engage said slots and wherein said at least two central portions are vertically spaced apart in the height of said game piece.

8. The game piece of claim 1, wherein said central portion is formed of a thin film.

9. A game piece for a simulated hockey game, comprising a peripheral portion configured to slide on a simulated hockey game surface and a central portion within said peripheral portion, wherein the majority of the mass of said game piece is in said peripheral portion, wherein said central portion has an outer periphery mounted to an inner periphery of said peripheral portion, wherein said central portion is made of a material different than the material of said peripheral portion, wherein said peripheral portion has an inner perimeter defining a vertical shelf and wherein said at least one central portion has an outer perimeter abutting said shelf.

10. The game piece of claim 9, wherein said outer perimeter of said at least one central portion is adhered to said shelf.

11. The game piece of claim 9, wherein said peripheral portion defines at least one slot in said inner perimeter, and wherein said outer perimeter of said at least one central portion is received in said slot.

12. The game piece of claim 11, wherein said peripheral portion defines at least two slots in an inner perimeter, wherein said slots are vertically spaced apart, and wherein outer perimeters of at least two central portions are received in said slots.

13. The game piece of claim 12, wherein said peripheral portion defines at least one shelf between said at least two central portions.

14. The game piece of claim 1, wherein said peripheral portion defines an opening through the height of said peripheral portion, and a said central portion is mounted to said peripheral portion to substantially close said opening.

15. The game piece of claim 14, wherein said peripheral portion and said central portion define air wells on top and bottom sides of said game piece.

* * * * *